US005494164A

United States Patent [19]

Ramirez

[11] Patent Number: 5,494,164

[45] Date of Patent: Feb. 27, 1996

[54] EGG CARTON

[75] Inventor: Richard L. Ramirez, Lawrenceville, Ga.

[73] Assignee: Dolco Packaging Corp., Sherman Oaks, Calif.

[21] Appl. No.: 308,326

[22] Filed: Sep. 19, 1994

[51] Int. Cl.[6] ..... B65D 85/32; B65D 81/02

[52] U.S. Cl. ..... 206/521.8; 206/521.3; 220/508

[58] Field of Search ..... 206/521.3, 521.4, 206/521.6, 521.9, 521.1; 220/508

[56] References Cited

U.S. PATENT DOCUMENTS

| | | | |
|---|---|---|---|
| 2,600,130 | 6/1952 | Schilling | 206/521.1 |
| 2,885,136 | 5/1959 | Grant . | |
| 3,034,693 | 5/1962 | Cox . | |
| 3,310,217 | 3/1967 | Trimble | 206/521.5 |
| 3,372,854 | 3/1968 | Marcus | 206/521.1 |
| 3,396,895 | 8/1968 | Pearl et al. | 206/521.8 |
| 3,486,678 | 12/1969 | Donaldson . | |
| 3,563,446 | 2/1971 | Lake . | |
| 3,572,578 | 3/1971 | Rohdin | 206/521.8 |
| 3,672,693 | 6/1972 | Weir . | |
| 3,767,103 | 10/1973 | Reifers | 206/521.8 X |
| 3,817,441 | 6/1974 | Jackson . | |
| 3,917,152 | 11/1975 | Burkett . | |
| 4,059,219 | 11/1977 | Reifers et al. . | |
| 4,382,536 | 5/1983 | Congleton . | |
| 4,394,214 | 7/1983 | Bixler et al. . | |
| 4,419,068 | 12/1983 | Congleton . | |
| 4,742,953 | 5/1988 | Jacobs et al. . | |
| 4,795,080 | 1/1989 | McIntyre | 206/521.8 X |
| 5,282,534 | 2/1994 | Lapp | 206/521.1 X |

FOREIGN PATENT DOCUMENTS

| | | |
|---|---|---|
| 727439 | 2/1966 | Canada . |
| 143955 | 2/1954 | Sweden . |

OTHER PUBLICATIONS

Mobil Chemical Advertisement, "The 18 Egg Foam Carton Designed for High Performance", Feb. 10, 1986.

*Primary Examiner*—Bryon P. Gehman
*Attorney, Agent, or Firm*—Robbins, Berliner & Carson

[57] ABSTRACT

An egg carton integrally molded from a sheet of polystyrene material has a cover and a tray having a plurality of cells. Each cell has a bottom, and exterior and interior sidewalls extending from the bottom and surrounding said each cell and a hinge interconnecting the tray and the cover. According to one aspect of the invention, the sidewalls of each cell are configured such that expansion of the cell is biased toward the interior of the egg carton.

4 Claims, 4 Drawing Sheets

EGG CARTON

FIELD OF THE INVENTION

The present invention is related in general to egg cartons and in particular to improvements for egg cartons made with resilient materials such as thermoplastic polystyrene.

BACKGROUND AND SUMMARY OF THE INVENTION

Eggs are classified based upon the minimum weight per dozen thereof. Presently, the classification is made at three ounce increments, and there are 6 classes in the classification, starting from a "peewee" class of eggs which weigh between 15–17 ounces per dozen, a "small" class of eggs which weigh between 18–20 ounces per dozen, and so on, to a "jumbo" class of eggs which weigh between 30–32 ounces per dozen. However, the classification may be increased to include eggs which weigh between 33–35 ounces per dozen (which are sometimes called "large jumbo" class) and eggs which weigh over 36 ounces per dozen (which are sometimes called "super jumbo" class).

To store, ship and merchandize the larger classes of eggs, the size of egg cartons will have to be increased. However, when larger egg cartons are used to hold larger eggs, it is preferable that they can still be stacked and fit into existing egg carton containers (i.e., the egg baskets). This becomes a limitation to the design of larger egg cartons. For example, egg cartons generally have a plurality of cells each for holding an egg. When a larger egg is placed into a cell, the cell will have to expand. However, clearance allowable for such expansion will decrease when larger egg cartons must be placed into existing egg carton containers.

Moreover, as the size of the egg cartons increases, conventional egg carton structures are found to be unsatisfactory for several reasons. One of the problems, for example, is that conventional egg cartons, while strong enough to hold smaller eggs, will lack sufficient strength and resiliency to hold the larger eggs, which are heavier and usually more fragile.

The increase in size of egg cartons also manifests several other defects in conventional egg carton structures. For example, common thermoplastic polystyrene egg cartons generally have a locking flap, with one or more nubs, which is built to have a tendency to push itself outward so that, when closed, the nubs can engage corresponding holes in the cover. To close the carton, the flap must be pushed inward, usually at its center, so that the cover can cover the flap. However, as the egg cartons become longer and because of the resilient nature of the material, it will become more difficult to push the flap completely inside the cover by pushing the center.

A general object of the present invention is to provide egg carton improvements which can facilitate the storage, shipping and merchandizing of large size eggs and use of the egg carton by customers.

For example, one important object of the present invention is to provide an egg carton structure wherein expansion of a cell can be biased towards the interior of the egg carton, so that larger egg cartons can still fit in conventional egg carton containers, and the cells can still expand to accommodate large eggs.

According to one aspect, the present invention provides an egg carton which is integrally molded from a sheet of polystyrene material, and which has a cover and a tray. The tray is hingedly connected to the cover and has a plurality of cells. Each cell has a bottom, a top edge, at least one individual exterior wall and at least one individual interior sidewall. The exterior and interior sidewalls extend from the bottom to surround the cell, with the interior sidewall of adjacent cells interconnecting at an apex. The interior and exterior sidewalls of each cell are contoured such that expansion of the cell is biased toward the interior of the egg carton.

According to another aspect, the present invention provides an egg carton which is integrally molded from a sheet of polystyrene material, and which has a cover and a tray. The tray is hingedly connected to the cover and has a plurality of cells. Each cell has a bottom, and exterior and interior sidewalls which extend from the bottom to surround the bottom. The cover has a recess for storing printed material.

In still another aspect, the present invention provides an egg carton which is integrally molded from a sheet of polystyrene material, and which has a cover and a tray. The tray has a plurality of cells. Each cell has a bottom, and exterior and interior sidewalls which extend from the bottom to surround the cell. The egg carton also has a hinge interconnecting a first wall of the tray and a first wall of the cover. The egg carton also has a locking flap extending from a second wall of the tray, and which has one or more nubs for engaging corresponding one or more holes in the second wall of the cover. The flap has a bottom edge connecting to the second wall, a top edge opposite the bottom edge and two side edges. The top edge of the flap is shorter than the bottom edge of the flap by a length which is a function of the resiliency and length of the flap.

In still another aspect, the present invention provides an egg carton which is integrally molded from a sheet of polystyrene material. The egg carton has a cover and a tray hingedly connected to the cover. The tray has a plurality of cells arranged in a matrix, with at least two parallel rows of cells and at least four cells in each row, each cell having a bottom, and exterior and interior sidewalls extending from the bottom to surround the cell. The egg tray has a plurality of intersections formed by sidewalls of groups of four adjacent cells. The intersections include a first intersection located at substantially the center of the tray, and at least two second intersections one on each side of the first intersections removed from the center, and where each of the second intersections is lower than the first intersection.

BRIEF DESCRIPTION OF THE DRAWINGS

A complete understanding of the present invention and of the above identified and other advantages may be understood from the following description of the preferred embodiment in conjunction with the following drawings.

DETAILED DESCRIPTION OF THE INVENTION

Figure 1:
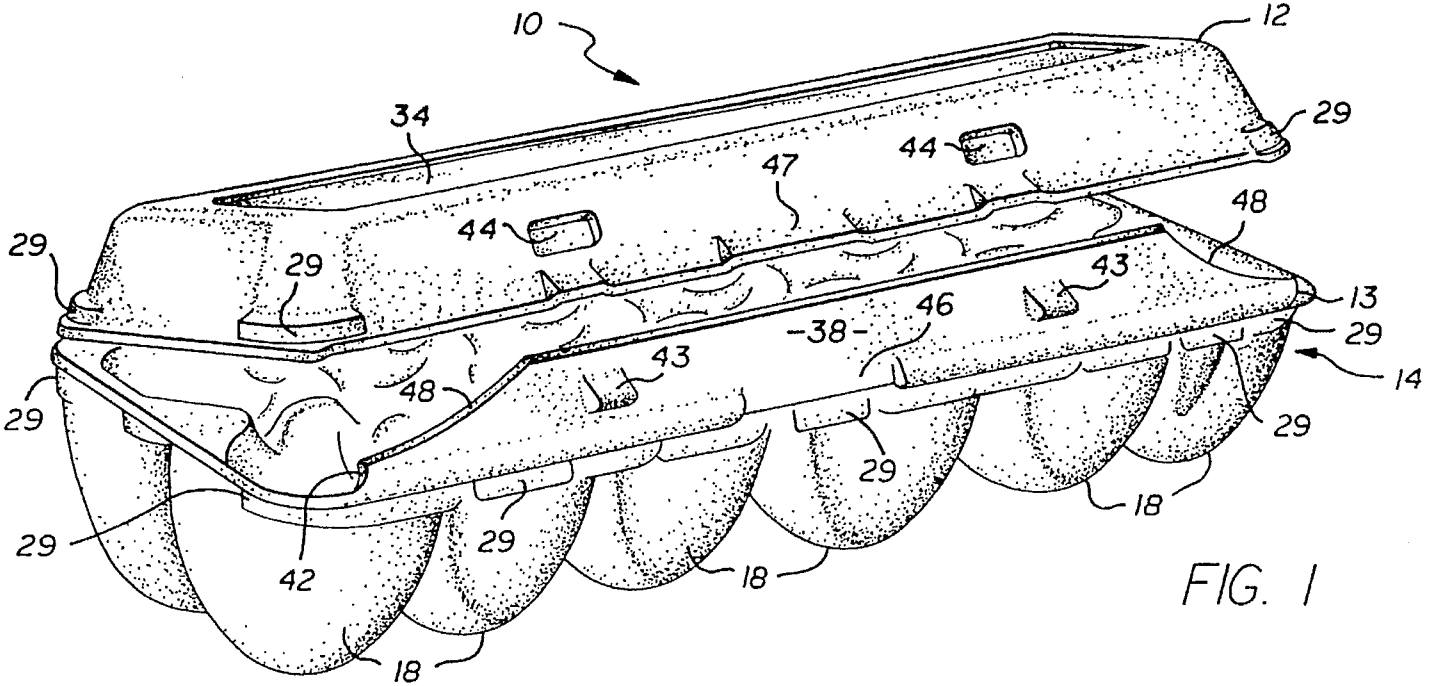
FIG. 1 is a perspective view of an egg carton wherein the present invention is embodied.
Figure 2:
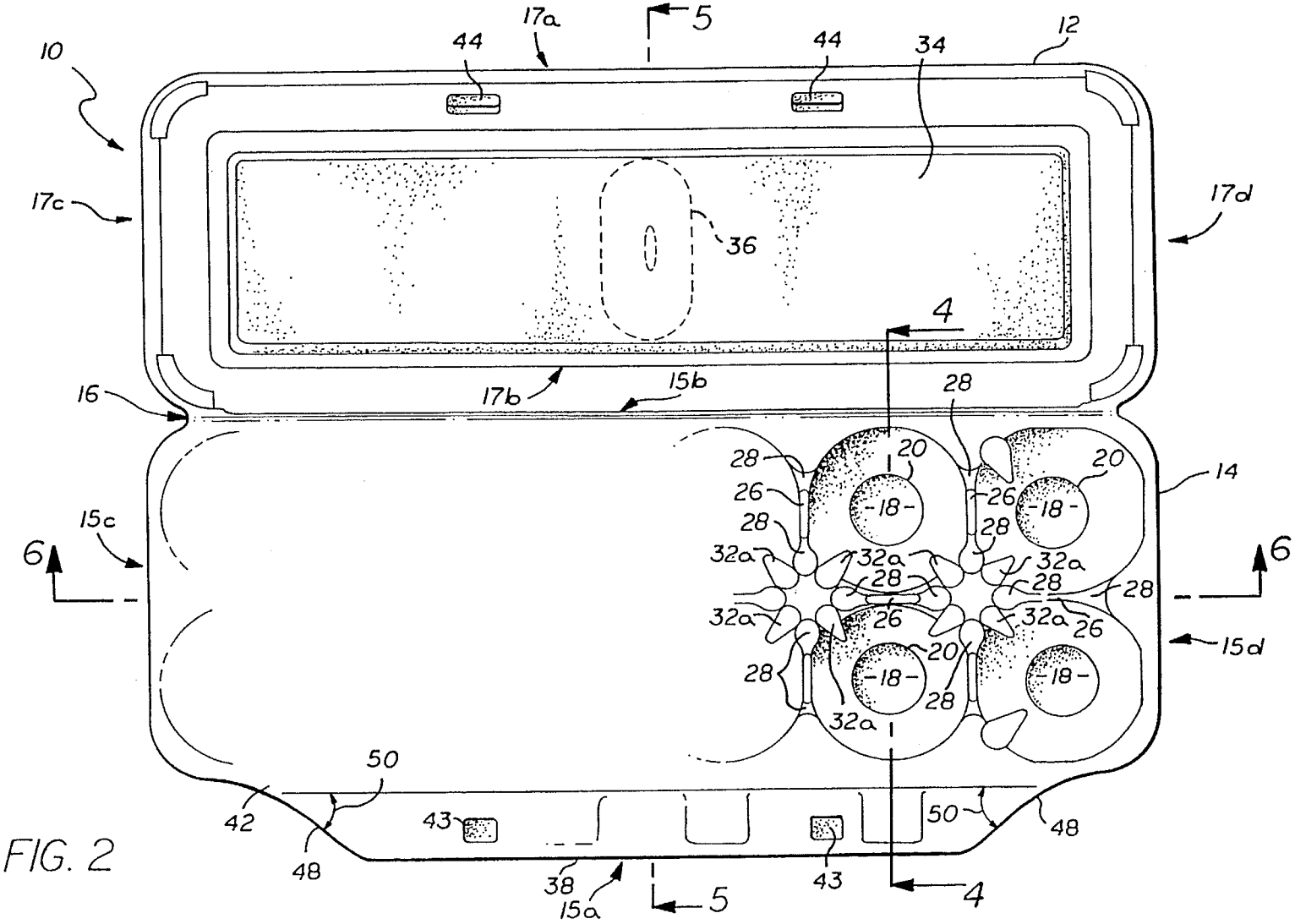
FIG. 2 is a view of the exterior of the egg carton shown in FIG. 1 when the egg carton is open.

FIG. 1 shows and egg carton 10 which is integrally molded from a sheet of thermoplastic polystyrene material. The egg carton 10 includes a cover 12 and a tray 14 interconnected by a hinge 16 (see FIG. 2). The tray 14 has a top edge 13, a front 15*a*, a back 15*b*, a left end 15*c* and a right end 15*d*. Correspondingly, the cover 12 also has a front 17*a*, a back 17*b*, a left end 17*c* and a right end 17*d*.

The tray 14 has a plurality of cells 18 each for holding an egg (not shown). The cells 18 are configured as a 2×6 matrix. Although a 2×6 matrix is used herein to describe the invention because it is a common configuration of egg cartons, it will be understood, however, that the present invention is applicable to improve egg cartons with other configurations.

Figure 3:
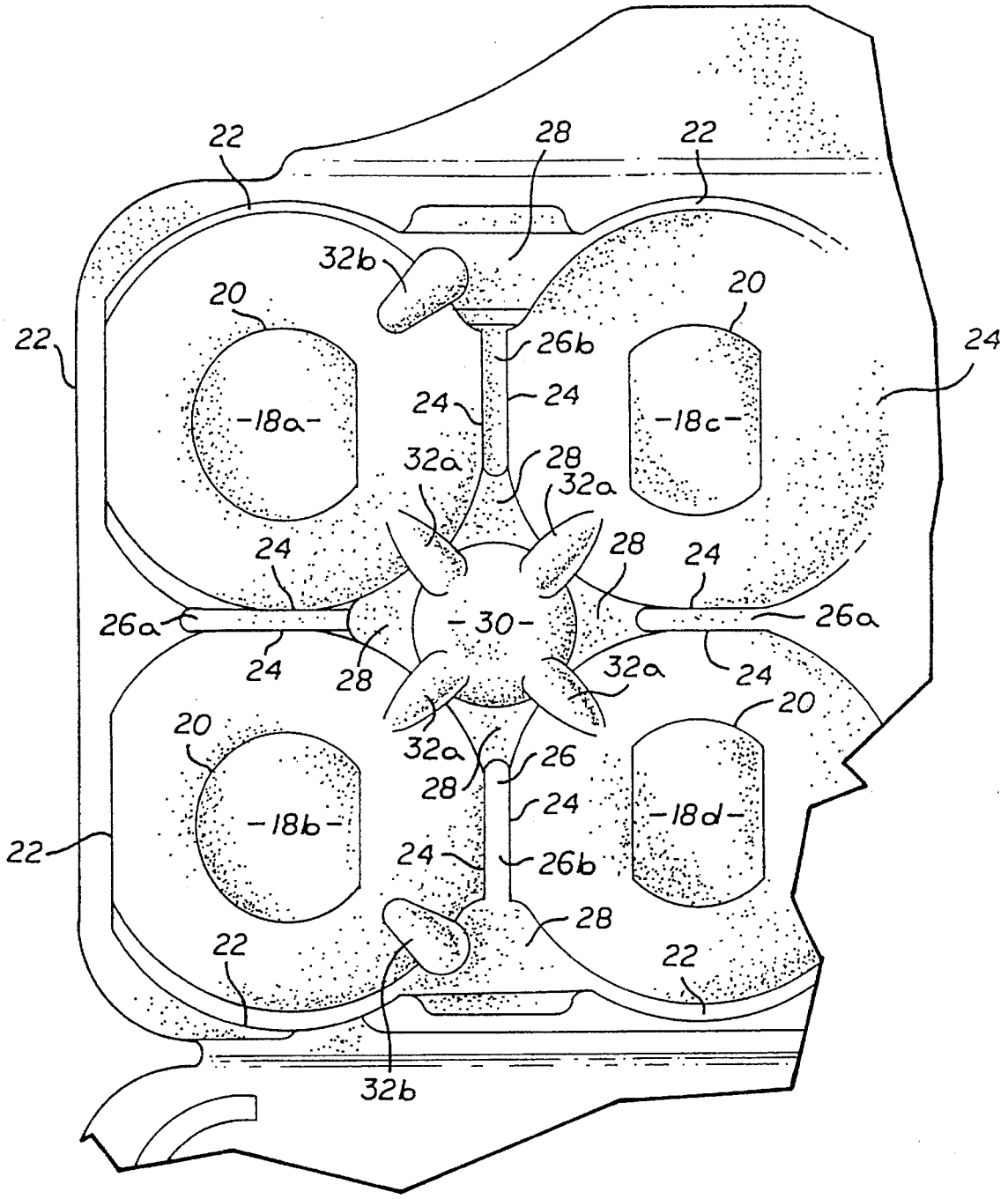
FIG. 3 is a fragmentary plan view of the egg supporting tray of the egg carton.

Each cell 18 has a bottom 20 (see FIGS. 2 and 3), and one or more exterior sidewalls 22 which form part of the exterior of the egg carton 10, and one or more interior sidewalls 24 facing the interior of the egg carton 10. The sidewalls 22, 24 extend from the bottom 20 to surround the corresponding cell 18. Depending on the location of a cell 18 within the matrix, a cell 18 may have two or three interior sidewalls 24, and one or two exterior sidewalls 22. For example, cells 18*a* and 18*b*, which are located at one end, 15*c* or 15*d*, of the egg carton 10, each has two interior sidewalls 24 and two exterior sidewalls 22. Cells 18*d* and 18*c*, on the other hand, which are located on the front edge 15*a* and on the back edge 15*b*, respectively, of the egg carton 10, each has three interior sidewalls 24 and one exterior sidewall 22. The interior sidewalls 24 between each pair of adjacent cells 18 are separate from each other (see FIG. 4), and extend from the respective bottoms 20 of the cells 18, interconnecting therebetween at an apex below the top edge 13 of the tray 14 to form a saddle 28. A central portion of the saddle 28 extends further upward to form a tab 26, preferably with a trapezoidal shape (see FIGS. 4 and 6). The saddle 28 and the tab 26, formed by the interior sidewalls 24 of two adjacent cells 18 within the same row (e.g., cells 18*b* and 18*d* in FIG. 3), serve as a transverse partition 26*b* between the two corresponding cells 18*b* and 18*d*. The saddle 28, formed by the interior sidewalls 24 of two adjacent cells 18 of different rows (e.g., cells 18*a* and 18*b*), serves as a longitudinal partition 26*a* between the two corresponding cells (e.g., 18*a* and 18*b*). For the egg carton 10 described herein with 2 rows of cells and 6 cells in each row, there are six longitudinal partitions 26*a*. These six partitions 26*a* are aligned along the central axis of the egg carton 10, dividing the cells into the two rows. There are five pairs of transverse partitions 26*b*, dividing each row of cells 18 into six cells.

Each pair of transverse partitions 26*b* intersect with the longitudinal partitions 26A at an intersection 30. In other words, each intersection 30 is formed by the interior sidewalls 24 of each group of the four adjacent cells 18, which together converge at the intersection 30. In the 2×6 configuration, there are five intersections in the egg carton 10, including an intersection 30*a* at the center of the egg carton 10, two intermediate intersections 30*b* and two end intersections 30*c* (see FIG. 6).

A vertical expansion groove or pleat 32*a* is formed on the interior sidewalls 24 at the corner of each cell 18 adjacent each intersection. Each expansion groove 32*a* extends from near the bottom 20 of the cell 18 to the top of the intersection 30. Because of the expansion groove 32*a*, each intersection 30 has substantially the shape of a clover-leaf. Optionally, an expansion groove 32*b* can be provided between an exterior sidewall 22 and interior sidewall 24 of a corner cell 18*a* (see FIG. 3).

Figure 4:
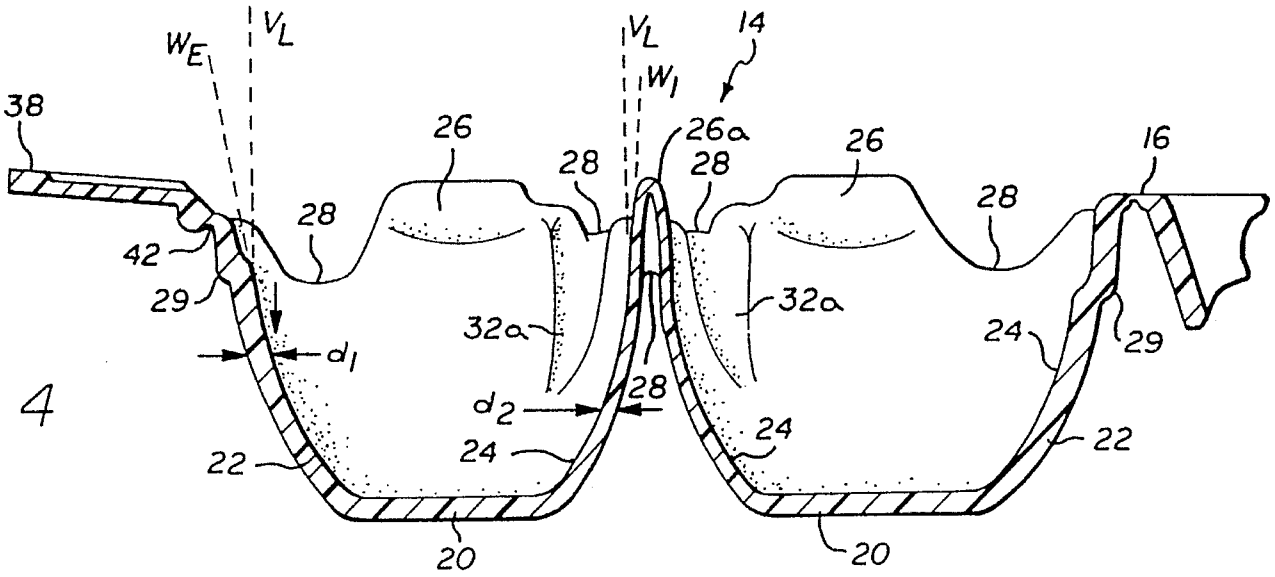
FIG. 4 is a cross-sectional view at line 4—4 of the egg carton shown in FIG. 1 and shows the configuration of the arc shaped walls and the inner cell pleats.
Figure 5:
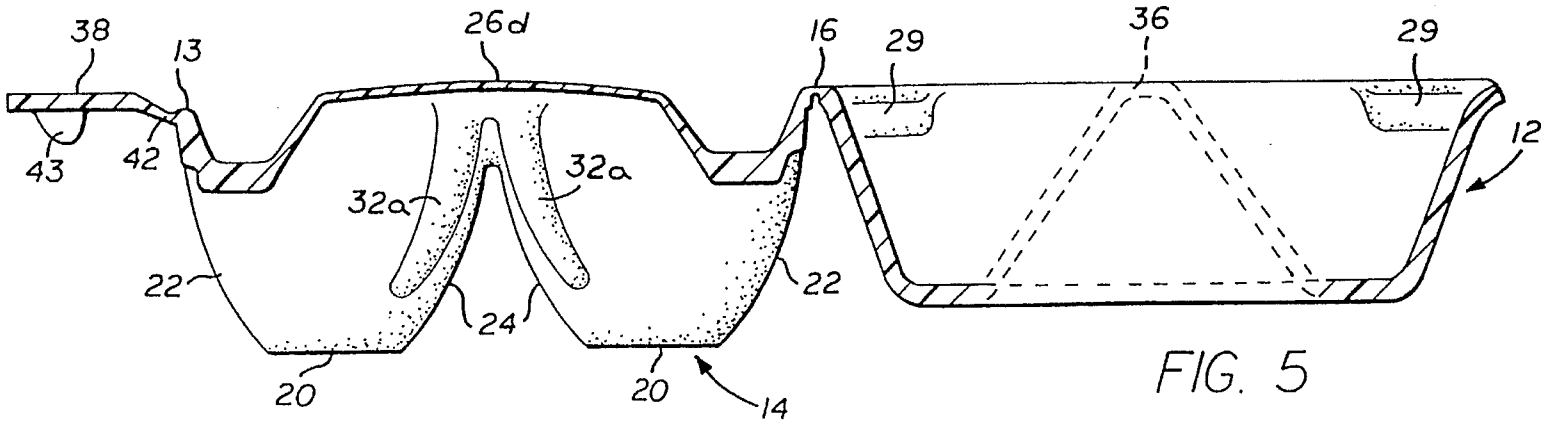
FIG. 5 is a cross-sectional view at line 5–5 of the egg carton shown in FIG. 1.

When a larger egg is placed in a cell 18, the expansion groove 32*a* therein expands, if necessary, thereby expanding the cell 18 to accommodate the egg. Because the expansion grooves 32*a* are located at the interior of the cell 18 and adjacent to the intersection 30, expansion of the cells 18 is directed to the interior of the egg carton 10. According to one aspect of the present invention, the interior sidewalls 24 of each cell 18 are more vertically contoured relative to the exterior sidewalls 22. With reference to FIG. 4, in a preferred implementation, line $W_E$ represents the tangent of the exterior sidewalls 22 adjacent the top edge 13 of the tray 14 and line $W_I$ represents the tangent of the interior sidewalls 24 adjacent the top edge 13 of the tray 14. As shown in FIG. 4, the angle between line $W_E$ and the vertical line $V_L$ is greater than the angle between line $W_I$ and the vertical line $V_L$. In the preferred embodiment, line $W_I$ is substantially vertical.

Because of the difference of the angles which the exterior sidewalls 22 and the interior sidewalls 24 respectively make with the vertical, when an egg is placed in a cell 18, the horizontal component of the force exerted by the exterior sidewall(s) 22 on the egg will be greater than the horizontal component of the force exerted by the interior sidewall(s) 24. As a result, expansion of the cell 18 will be biased towards the interior of the egg carton 10. In other words, when a cell 18 is required to expand to accommodate a larger egg (such as when a larger egg is to be packaged or when an egg is placed pointed upward), expansion of the cell 18 will be accomplished by pushing the interior sidewalls 24 of the corresponding cell 18. Alternatively, the contour of the exterior sidewalls 22 along a vertical line can be made to have a smaller radius of curvature than the contour of the interior sidewalls 24 so that expansion of the cells 18 is biased towards the interior of the carton 10.

The difference between the respective contours of the exterior sidewalls 22 and the interior sidewalls 24 together with the presence of the expansion groove 32 at the interior side of each cell 18 cause the centers of the cells 18 to be redefined and shifted towards the interior of the egg carton 10 when larger eggs are placed into the cells 18. Additional cell space is thus taken from within the interior of the egg carton 10 rather than the exterior, leaving the exterior of the egg carton 10 substantially unchanged.

Preferably, to further bias expansion of the cells towards the interior, the thickness d1 (see FIG. 4) of a portion of the exterior sidewalls 22 is made larger than the thickness d2 of the interior sidewalls 24. The relative thicker exterior sidewalls 22 makes expansion of the cells 18 towards the exterior more difficult. The thicker exterior sidewalls 22 also provide better protection to the eggs.

Referring again to FIGS. 1 and 2, according to another aspect of the present invention, a recess 34 is formed on the top surface of the cover 12. The recess 34 can provide an area for placing one or more sheets of printed material such as labels, coupons, advertisements and the like, or other articles such as a gift, to be sent to the customers along with the eggs in the egg carton 10.

Egg cartons are shipped by stacking them inside a container. When the egg cartons are stacked, vertical pressure will be experienced by an egg carton from egg cartons stacked above. To increase the vertical support of the egg carton 10 and to protect eggs from the vertical pressure, a lid post 36 can optionally be formed on the cover 12 at the center thereof. The lid post 36 is aligned with the central transverse partition 26*d* (i.e. the transverse partition 26*d* passing through the central intersection 30*a*). When the egg carton 10 is closed, the lid post 36 will rest against the central transverse partition 26*d*. Preferably, the lid post 36 has the same height as the depth of the cover 12, and the central transverse partition 26*d* is extended above the top edge 13 of the tray 14, or vice versa, so as to increase the vertical support of the egg carton 10.

A locking flap 38 extends from the front edge 15*a* of the tray 14 through a hinge 42. One or more protrusions, such as nubs 43, are formed on the locking flap 38. These nubs 43 are provided to engage corresponding one or more holes 44 on the front wall of the cover 12. The locking flap 38 has a recess 46 (see FIG. 1) at the center of the locking flap 38 adjacent the hinge 42. When the cover 12 covers the tray 14 and the nubs 43 are engaged to the holes 44, the recess 46 allows a customer to more conveniently place a finger (not shown) on the locking flap 38 to push the locking flap 38 inward to disengage the nubs 43 from the holes 44, to thereby unlock the cover 12 from the tray 14. Preferably, a raised notch 47 is provided on the cover 12 corresponding to the position of the recess 46 so as to increase the space where the finger can be placed to open the cover 12.

Because of the resilient nature of thermoplastic polystyrene, when the locking flap 38 is pushed inward at the recess 46, the sides 48 of the locking flap 38 may not move inward with the same distance through which the center of the locking flap 38 is pushed. As a result, the sides 48 may not be able to move inside the cover 12, but will instead block the cover 12 from engaging the tray 14. According to one aspect of the invention, the sides 48 are preferably made to have a scalloped shape and extend from the tray at an angle 50 (see FIG. 2). The shape and the angle 50 is preferably a function of the resiliency of the material and the length of the egg carton 10.

Figure 6:
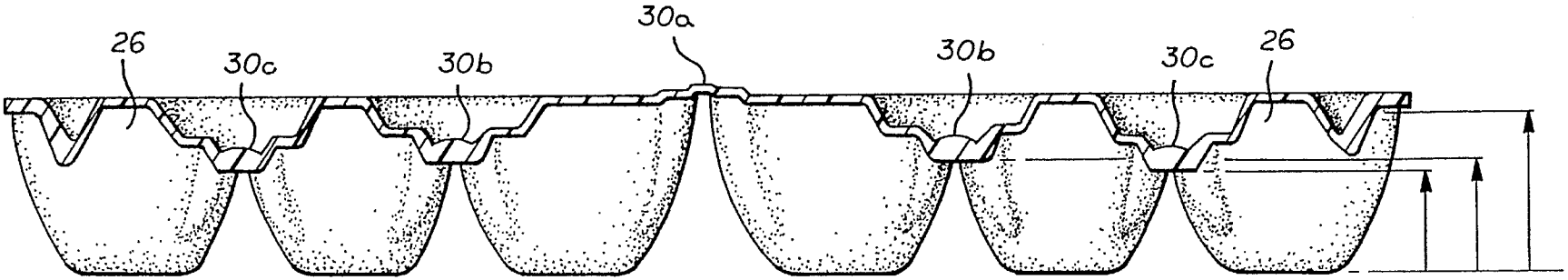
FIG. 6 is a cross-sectional view at line 6—6 of the egg carton shown in FIG. 1.

To strengthen the egg carton 10 at both ends 15*c*, 15*d*, the intersections 30 are progressive lowered as their distance from the center of the egg carton increase (see FIG. 6). For example, in the egg carton 10 according to the preferred embodiment, the two end intersections 30*c* are lower (or closer to the bottom of the cells) than the two intermediate intersections 30*b*, which in turn are lower than the intersection 30*a* at the center of the egg carton 10. To lower the intersections 30*b* and 30*c*, the interior sidewalls 24 which form the corresponding saddles 28 are merged at a lower point. However, even when the saddles 28 are made lower, the heights of the partitions are maintained by increasing the length of the tabs 26.

According to one aspect of the present invention, at least one surface of the egg carton 10 is made large enough to provide a display panel for such information of graphics or nutritional data. The surface can be an external or internal surface of either the front 17*a*, back 17*b*, or sides 17*c*, 17*d* of the cover 12, or a surface of the front 15*a*, back 15*b* or sides of the tray 14, Because the egg carton 10 may be larger than conventional egg cartons. When put in a conventional container, egg cartons 10 may have to be stacked, with the egg cartons 10 on an upper stack placed between two egg cartons 10 in the intermediate lower stack. To facilitate stacking of the egg cartons, a plurality of stacking lugs 29 are provided on the tray 14 below the top edge 13.

Although the present invention is described with reference to the above structure, it will be understood that the scope of this invention is not limited by the shape and size of the cells, the number of cells or the number of rows of cells disclosed above. Moreover, the present invention may also be applicable to egg cartons made with other materials. The above structure is described for purposes of illustrating the embodiment which the inventor hereof considers as the best mode of practicing the invention. It will be apparent to those skilled in the art that various modifications and implementations can be made therein without departing from the spirit and scope of the invention.

What is claimed is:

1. An egg carton integrally molded from a sheet of polystyrene material, comprising:

a cover; and a tray, hingedly connected to the cover, having a plurality of cells, each of said cells having a bottom, an opening, at least one separate exterior wall and at lease one separate interior sidewall facing said exterior wall, said exterior and said interior sidewalls extending from the bottom and surrounding said each cell, the interior sidewalls of adjacent cells extending from respective bottoms thereof and interconnecting therebetween at an apex, the vertical contour of each exterior and interior sidewall having a substantial radius of curvature, the vertical contour of each exterior sidewall having a smaller radius of curvature than the vertical contour of the respective facing interior sidewall whereby expansion of the cell is biased toward the interior of the egg carton.

2. An egg carton integrally molded from a sheet of polystyrene material, comprising:

a cover;

a tray hingedly connected to said cover, said tray having a plurality of cells arranged in a matrix with at least two parallel rows of six cells in each row, each cell having a bottom, and exterior and interior sidewalls extending from the bottom and surrounding said corresponding one of said cells; wherein adjacent interior sidewalls of each of the cells in one row extend separate from respective bottoms of said cells in the adjacent row so that the interior sidewalls of each respective pair of cells merge at an apex; and a plurality of intersections formed by the interior sidewalls of each group of four adjacent cells, including:

a first intersection located at substantially the center of said tray;

two second intersections, one at each side of said first intersection, spaced from the center, wherein each of said two second intersections is lower than said first intersection; and two third intersections, one at each side of an adjacent second intersection, spaced from said adjacent second intersection, wherein each of said third intersections is lower than the adjacent second intersection.

3. An egg carton as in claim 2, further including a flat tab extending from each apex as a continuation of the apex material, said tab being formed of substantially parallel portions of said apex material.

4. An egg carton as in claim 2, wherein each cell has a vertical expansion groove at each intersection.

* * * * *